US007451615B2

(12) United States Patent
Matsuoka et al.

(10) Patent No.: US 7,451,615 B2
(45) Date of Patent: Nov. 18, 2008

(54) REFRIGERATION DEVICE

(75) Inventors: Hiromune Matsuoka, Sakai (JP); Kazuhide Mizutani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 746 days.

(21) Appl. No.: 10/521,753

(22) PCT Filed: Jul. 22, 2003

(86) PCT No.: PCT/JP03/09286

§ 371 (c)(1),
(2), (4) Date: Jan. 19, 2005

(87) PCT Pub. No.: WO2004/013550

PCT Pub. Date: Feb. 12, 2004

(65) Prior Publication Data

US 2005/0252236 A1 Nov. 17, 2005

(30) Foreign Application Priority Data

Aug. 2, 2002 (JP) ..... 2002-225822

(51) Int. Cl.
*F25B 1/00* (2006.01)

(52) U.S. Cl. ..... 62/498; 62/114; 62/513

(58) Field of Classification Search ..... 62/114, 62/197, 324.1, 498, 513
See application file for complete search history.

(56) References Cited

U.S. PATENT DOCUMENTS

| | | | | |
|---|---|---|---|---|
| 5,142,879 | A * | 9/1992 | Nakamura et al. | 62/160 |
| 5,548,968 | A * | 8/1996 | Sada | 62/175 |
| 6,343,482 | B1 * | 2/2002 | Endo et al. | 62/324.6 |

FOREIGN PATENT DOCUMENTS

| | | | |
|---|---|---|---|
| JP | 6-323643 | A | 11/1994 |
| JP | 8-49948 | A | 2/1996 |
| JP | 08-27092 | B2 | 3/1996 |
| JP | 2001-355924 | A | 12/2001 |
| JP | 2002-106984 | A | 4/2002 |
| JP | 2002-156149 | A | 5/2002 |

* cited by examiner

*Primary Examiner*—Melvin Jones
(74) *Attorney, Agent, or Firm*—Global IP Counselors, LLP

(57) ABSTRACT

A refrigeration device is provided that has a compressor, a heat source side heat exchanger, and a user side heat exchanger. The refrigeration device also has a condenser arranged between the compressor and the user side heat exchanger. The condenser is arranged to condense a portion of the refrigerant that is compressed in the compressor and that is sent to the user side heat exchanger.

18 Claims, 5 Drawing Sheets

Refrigeration Pressure
Enthalpy
$P_{d1}$
$P_{a1}$
$P_{e1}$
$P_{s1}$
$B_1$
$A_1$
$C_1$
$D_1$
$E_1$
$F_1$
$h_{A1}$
$h_{D1}$
$h_{E1}$
$\Delta h_{D1}$
$\Delta h_{E1}$ $P_{d2}$
$P_{a2}$
$P_{e2}$
Refrigeration Pressure
$P_{f2}$
$P_{s2}$
$H_2$
$I_2$
$B_2$
$C_2$
$D_2$
$E_2$
$F_2$
$G_2$
$A_2$
Enthalpy

REFRIGERATION DEVICE

TECHNICAL FIELD

The present invention relates to a refrigeration device, and more particularly to a refrigeration device having a vapor compression type of refrigerant circuit.

BACKGROUND ART

One example of a conventional refrigeration device that includes a vapor compression refrigeration circuit is an air conditioner that is employed to provide air conditioning for buildings or the like. This type of air conditioner primarily includes a heat source unit, a plurality of user units, and a refrigerant gas junction line and a refrigerant liquid junction line that serve to connect these units together. The refrigerant gas junction line and the refrigerant liquid junction line of the air conditioner are positioned so as to connect the heat source unit and the plurality of user units, and thus the lines are long and have a complex line shape that includes many curves and branches along the length thereof. Because of this, when the air conditioner is to be renovated, there will be many occasions in which only the heat source unit and the user units are renovated, and the refrigerant gas junction line and the refrigerant liquid junction line of the preexisting device are left in place.

In addition, many conventional air conditioners use an HCFC refrigerant such as R22. The lines, devices, and the like that form the refrigerant circuit of this type of air conditioner have a strength that corresponds to the saturation pressure of the operating refrigerant at a normal temperature. However, because environmental problems are being taken into consideration in recent years, there are continuing efforts being made to replace HCFC refrigerants with HFC or HC refrigerants. Because of this, air conditioners that are employed to air condition buildings or the like are being renovated by replacing the preexisting heat source unit and the user units that use R22 as the operating refrigerant with devices that use HFC refrigerants such as R407C that approximate the saturation pressure characteristics of R22 as the operating refrigerant, and reusing the refrigerant gas junction line and the refrigerant liquid junction line of the preexisting air conditioner.

On the other hand, it is desirable for the aforementioned air conditioner to have improved refrigeration efficiency and reduced power consumption. In order to meet these needs, using HFC refrigerants such as R410A and R32 that have saturation pressure characteristics that are higher than those of R22 or R407C has been considered. However, if one attempts to use a refrigerant such as R410A or R32 as the operating refrigerant, not only will the heat source unit and the user units have to be replaced, but the refrigerant gas junction line and the refrigerant liquid junction line will also have to be replaced with lines that have strengths corresponding to the saturation pressure characteristics thereof, and thus the task of installing the air conditioner will be more burdensome than before.

An example of an air conditioner that is capable of solving these types of problems is the air conditioner disclosed in Japanese Published Patent Application No. 2002-106984. This air conditioner has a refrigeration circuit that includes a compressor, a heat source side heat exchanger, and user side heat exchangers, and a heat source side auxiliary heat exchanger that is connected in parallel to the heat source side heat exchanger. When the refrigerant pressure on the discharge side of the compressor of the air conditioner increases during cooling operations, the refrigerant on the discharge side of the compressor is introduced into the heat source side auxiliary heat exchanger and condensed, and thus the refrigerant pressure of the refrigerant circuit between the discharge side of the compressor and the user side heat exchangers (including the refrigerant liquid junction line) can be decreased. This allows the heat source unit and the user units to be replaced with those that use R410A as the operating refrigerant, and allows the refrigerant liquid junction line of the preexisting air conditioner that employs R22 and the like to be left in place and reused.

However, the heat source side auxiliary heat exchanger of the aforementioned air conditioner is provided in order to adjust the refrigerant pressure of the refrigerant circuit between the heat source side heat exchanger and the user side heat exchangers that includes the refrigerant liquid junction line during cooling operations, and is not designed to adjust the refrigerant pressure of the refrigerant gas junction line during heating operations. Because of this, it is assumed that, during heating operations, the air conditioner will be operated so as to maintain the heating ability in each user unit, while making the discharge pressure of the compressor lower than the maximum allowable pressure of the refrigerant gas junction line. More specifically, in order to maintain heating ability in each user unit, the air conditioner must be operated so that the refrigerant gas temperature on the discharge side of the compressor is kept at a predetermined temperature, and the discharge pressure of the compressor is made lower than the maximum allowable pressure of the refrigerant gas junction line.

However, because R410A has saturation pressure characteristics that are higher than those of R22 and the like, when the intake temperature of the compressor is the same, only a discharge temperature that is lower than the discharge temperature obtained with R22 and the like can be obtained, even if the pressure is raised by means of the compressor to the same as the discharge pressure. Thus, to the extent possible, heating operations must be performed with the discharge pressure of the compressor raised to near the maximum allowable pressure of the refrigerant gas junction line in order to increase the refrigerant temperature. On the one hand, when the air conditioner is operated to raise the discharge pressure of the compressor to near the maximum allowable pressure of the refrigerant gas junction line, superior pressure control will be needed that is responsive to pressure increases, particularly rapid pressure fluctuations such as changes in heating load.

On the other hand, it is desirable for the aforementioned air conditioner to have improved refrigeration efficiency and reduced power consumption. In order to meet these needs, using HFC refrigerants such as R410A and R32 that have saturation pressure characteristics that are higher than those of R22 or R407C has been considered. However, if one attempts to use a refrigerant such as R410A or R32 as the operating refrigerant, not only will the heat source unit and the user units have to be replaced, but the refrigerant gas junction line and the refrigerant liquid junction line will also have to be replaced with lines that have strengths corresponding to the saturation pressure characteristics thereof, and thus the task of installing the air conditioner will be more burdensome than before.

In addition, as noted above, not only will there be situations in which the preexisting refrigerant gas junction line and the refrigerant liquid junction line of an air conditioner that used R22, R407C, and the like will be left in place and reused and a new heat source unit and user units that use refrigerant such as R410A, R32, and the like having saturation pressure characteristics that are higher that those of R22 and R407C will be used with the preexisting lines, but there will also be situations in which refrigerant gas junction lines and the refrigerant liquid junction lines that have saturation pressure characteristics that are higher than R410A, R32, and the like cannot be prepared, even when a new air conditioner is to be installed. In this situation as well, because the air conditioner is operated to raise the discharge pressure of the compressor to near the maximum allowable pressure of the refrigerant gas junction line, superior pressure control will be needed that is responsive to pressure increases, particularly rapid pressure fluctuations such as changes in heating load.

SUMMARY OF THE INVENTION

An object of the present invention is to stably control the refrigerant pressure in a refrigeration device having a vapor compression type of refrigerant circuit when refrigerant compressed in the compressor is sent to a user side heat exchanger.

According to a first aspect of the present invention, a refrigeration device basically includes a refrigerant circuit having a compressor, a heat source side heat exchanger, a user side heat exchanger and a condenser connected between the compressor and the user side heat exchanger. The condenser is configured to condense a portion of the refrigerant that is compressed in the compressor and that is sent to the user side heat exchanger.

With this refrigeration device, the condenser allows the pressure of the refrigerant to be sent to the user side heat exchanger to be lowered by condensing a portion of the refrigerant that is compressed in the compressor and sent to the user side heat exchanger. This allows the pressure of the refrigerant sent to the user side heat exchanger to be stably controlled.

According to a second aspect of the present invention, the refrigeration device of the first aspect is provided such that a check mechanism is connected between the compressor and the user side heat exchanger of the refrigerant circuit, and allows only the flow of refrigerant from the user side heat exchanger to the compressor. The condenser is connected to the refrigerant circuit via a branching circuit that propagates the flow of refrigerant cut-off by the check mechanism from the compressor to the user side heat exchanger, and a junction circuit that sends refrigerant condensed in the condenser to to the user side heat exchanger.

With this refrigeration device, the refrigerant can flow through the branching circuit, the condenser and the junction circuit when the refrigerant is to be sent from the compressor to the user side heat exchanger, and refrigerant can flow through the check mechanism of the main refrigerant circuit when the refrigerant is to be sent from the user side heat exchanger to the compressor.

According to a third aspect of the present invention, the refrigeration device of the first or second aspects of the present invention is further provided with a pressure detection mechanism to detect the pressure of the refrigerant that flows between the condenser and the user side heat exchanger.

With this refrigeration device, because a pressure detection mechanism that detects the refrigerant pressure between the condenser and the user side heat exchanger is provided, the pressure of refrigerant sent to the user side heat exchanger can be stably controlled by changing the heating load in the condenser in accordance with pressure variation.

According to a fourth aspect of the present invention, the refrigeration device of anyone of the first to third aspects of the present invention is further provided with a bypass circuit that can bypass the condenser and propagate refrigerant from the compressor to the user side heat exchanger.

With this refrigeration device, refrigerant can flow through the condenser and the bypass circuit when the refrigerant is to be sent from the compressor to the user side heat exchanger, and refrigerant can flow through the check mechanism of the main refrigerant circuit when the refrigerant is to be sent from the user side heat exchanger to the compressor.

According to a fifth aspect of the present invention, the refrigeration device of the fourth aspect of the present invention is further provided with an open/close mechanism configured to adjust the amount of the refrigerant that flows into the condenser.

With this refrigeration device, because an open/close mechanism is provided, the flow of refrigerant to the condenser can be propagated/cut-off in a timely manner, and adjustment of the amount of the refrigerant that flows into the condenser can be performed while condensing the refrigerant. This allows the pressure of the refrigerant sent to the user side heat exchanger to be stably controlled.

According to a sixth aspect of the present invention, the refrigeration device of anyone of the first to fifth aspects of the present invention is provided such that the compressor is a heat exchanger that uses the refrigerant which flows inside the refrigerant circuit as a cooling source.

With this refrigeration device, refrigerant that flows inside the refrigerant circuit is used as the cooling source, and thus another cooling source is unnecessary.

According to a seventh aspect of the present invention, the refrigeration device of anyone of the first to sixth aspects of the present invention is provided such the refrigerant has saturation pressure characteristics that are higher than those of R407C.

With this refrigeration device, refrigerant having saturation pressure characteristics higher than those of R407C can be used as the operating refrigerant, even in situations in which the maximum allowable pressure of the lines, equipment, and the like that form the circuits between the compressor and the user side heat exchanger can only be used up to the saturation pressure of R407C at normal temperatures, because the refrigerant gas to be sent to the user side heat exchanger can be reduced in pressure by condensing a portion of the refrigerant gas sent from the compressor to the user side heat exchanger by means of the condenser. Thus, for example, with a preexisting refrigeration device that uses R22 or R407C as the operating refrigerant, the refrigerant gas junction line between the condenser and the user side heat exchanger of the preexisting device can be reused even in situations in which a newly constructed refrigeration device uses a refrigerant having saturation pressure characteristics that are higher than those of R407C as the operating refrigerant.

DETAILED DESCRIPTION OF THE PREFERRED EMBODIMENTS

An air conditioner will be described below as an example of the refrigeration equipment of the present invention with reference to the figures.

(1) Overall Configuration of the Air Conditioner

Figure 1:
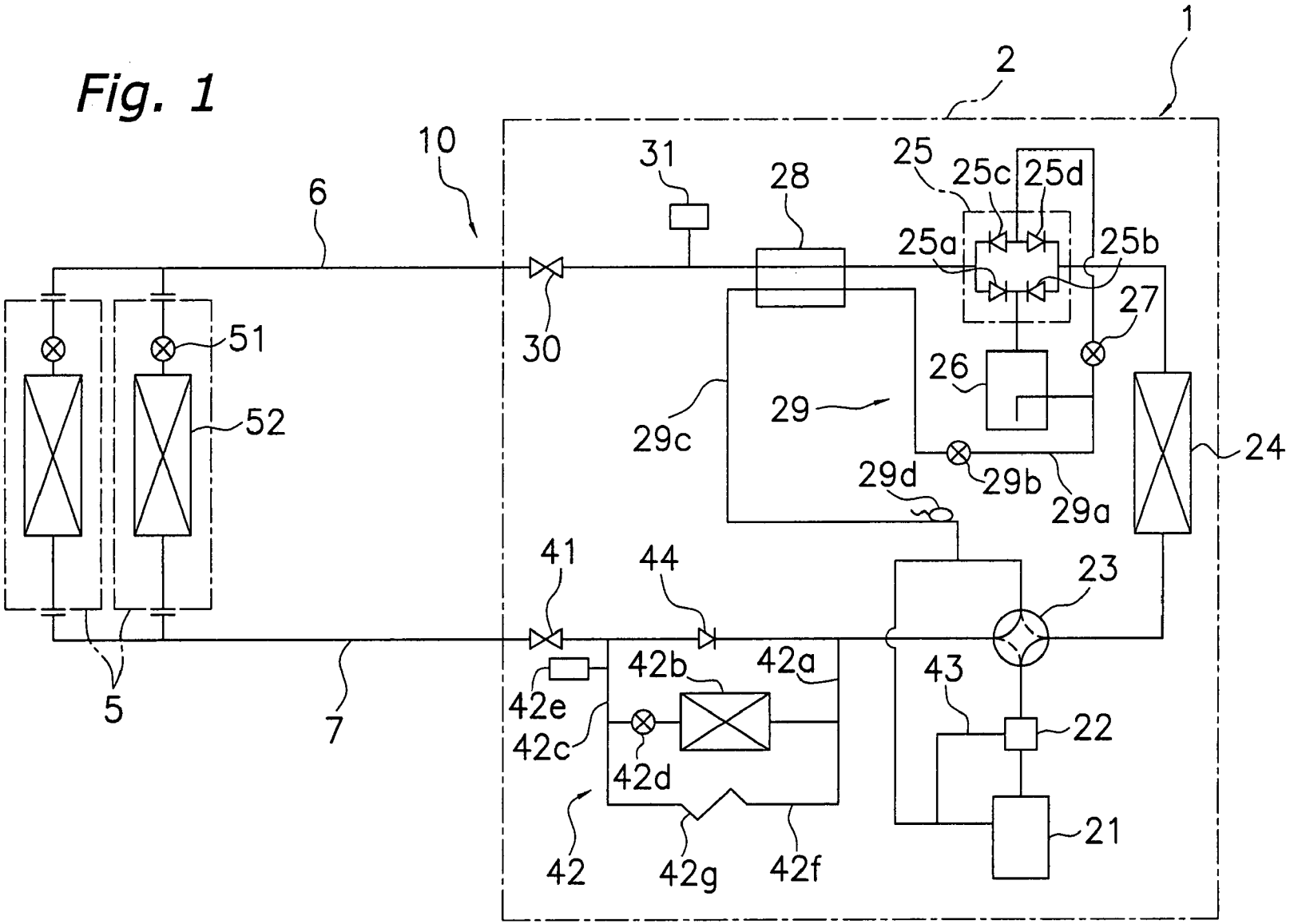
FIG. 1 is a schematic diagram of a refrigerant circuit of an air conditioner used as an example of the refrigeration equipment of the present invention.

FIG. 1 is a schematic diagram of a refrigerant circuit of an air conditioner 1 used as an example of the refrigeration equipment of the present invention. The air conditioner 1 is a device used, for example, to air condition and heat a building and the like, and includes one heat source unit 2, a plurality (2 in the present embodiment) of user units 5 connected in parallel thereto, and a refrigerant liquid junction line 6 and a refrigerant gas junction line 7 that connect the heat source unit 2 and the user units 5.

In the present embodiment, the air conditioner 1 uses R410A as an operating refrigerant, R410A having saturation pressure characteristics that are higher than those of R22, R407, and the like. Note that the type of operating refrigerant is not limited to R410A, and may be R32 or the like. In addition, in the present embodiment, the air conditioner 1 is configured to reuse preexisting heat source units and user units that used R22, R407, and the like as the heat source unit 2 and the user units 5. In other words, the refrigerant liquid junction line 6 and the refrigerant gas junction line 7 are the preexisting refrigerant liquid junction line and the refrigerant gas junction line, and can only operate at the saturation pressure characteristics of R22, R407C, or the like or lower. Because of this, it will be necessary to operate at the maximum allowable operating pressure or lower of the refrigerant liquid junction line 6 and the refrigerant gas junction line 7 in situations in which an operating refrigerant having saturation pressure characteristics that are higher than R410A, R32, or the like are used. More specifically, the refrigerant liquid junction line 6 and the refrigerant gas junction line 7 must be used in a range that does not exceed an operating pressure of approximately 3 MPa, which corresponds to the saturation pressure of R22 and R407C at a normal temperature. Note that the devices and lines that form the heat source unit 2 and the user units 5 are designed such that they can be used at the saturation pressure (approximately 4 MPa) of R410A at a normal temperature.

(2) Configuration of the User Units

The user units 5 primarily include a user side expansion valve 51, user side heat exchangers 52, and a line that connects these. In the present embodiment, the user side expansion valve 51 is an electric expansion valve that is connected to the liquid side of the user side heat exchangers 52, and serves to adjust the refrigerant pressure, refrigerant flow rate and the like. In the present embodiment, the user side heat exchangers 52 are cross fin tube type heat exchangers, and serve to exchange heat with indoor air. In the present embodiment, the user units 5 take in indoor air into the interior thereof, includes a fan for blowing (not shown in the figures), and is capable of exchanging heat between the indoor air and the refrigerant that flows in the user side heat exchangers 52.

(3) Configuration of the Heat Source Units

The heat source unit 2 is primarily composed of a compressor 21, an oil separator 22, a four way switching valve 23, a heat source side heat exchanger 24, a bridge circuit 25, a receiver 26, a heat source side expansion valve 27, a cooler 28, a first auxiliary refrigerant circuit 29, a liquid side gate valve 30, a gas side gate valve 41, a second auxiliary refrigerant circuit 42, and lines that connect these together.

In the present embodiment, the compressor 21 is an electric motor driven scroll type compressor, and serves to compress the refrigerant gas that has been drawn therein.

The oil separator 22 is arranged on the discharge side of the compressor 21, and is a vessel that serves to separate gas and liquid from oil that included in the refrigerant gas that has been compressed/discharged. The oil separated in the oil separator 22 is returned to the intake side of the compressor 21 via an oil return line 43.

When switching between cooling operations and heating operations, the four way switching valve 23 serves to switch the direction of the refrigerant flow. During cooling operations, the four way switching valve 23 is capable of connecting the outlet of the oil separator 22 and the gas side of the heat source side heat exchanger 24, and connects the intake side of the compressor 21 and the refrigerant gas junction line 7 (refer to the solid line of the four way switching valve in FIG. 1). During heating operations, the four way switching valve 23 connects the outlet of the oil separator 22 and the refrigerant gas junction line 7, and connects the intake side of the compressor 21 and the gas side of the heat source side heat exchanger 24 (refer to the broken line of the four way switching valve in FIG. 1).

In the present embodiment, the heat source side heat exchanger 24 is a cross fin tube type of heat exchanger, and serves to exchange heat between air and the refrigerant that acts as a heat source. In the present embodiment, the heat source unit 2 takes in outdoor air into the interior thereof, includes a fan for blowing (not shown in the figures), and is capable of exchanging heat between the outdoor air and the refrigerant that flows in the heat source side heat exchanger 24.

The receiver 26 is a vessel that serves to temporarily collect the refrigerant that flows between the heat source side heat exchanger 24 and the user side heat exchangers 52. The receiver 26 includes an inlet port on the upper portion of the vessel, and an outlet port on the lower portion of the vessel. The inlet and outlet of the receiver 26 are respectively connected to the refrigerant circuit between the heat source side heat exchanger 24 and the cooler 28 via the bridge circuit 25. In addition, the heat source side expansion valve 27 is connected between the outlet of the receiver 26 and the bridge circuit 25. In the present embodiment, the heat source side expansion valve 27 is an electric expansion valve that serves to adjust the refrigerant pressure and the refrigerant flow rate between the heat source side heat exchanger 24 and the user side heat exchangers 52.

The bridge circuit 25 is a circuit that is formed from four check valves 25*a* - 25*d* that are connected between the heat source side heat exchanger 24 and the cooler 28, and includes a function that makes refrigerant flow from the inlet side of the receiver 26 into the receiver 26, and returns the refrigerant liquid to the refrigerant circuit between the heat source side heat exchanger 24 and the user side heat exchangers 52 from the outlet of the receiver 26, even when the refrigerant that flows in the refrigerant circuit between the heat source side heat exchanger 24 and the user side heat exchangers 52 flows either into the receiver 26 from the heat source side heat exchanger 24 side, or flows from the user side heat exchangers 52 side to the receiver 26. More specifically, the check valve 25*a* is connected such that the refrigerant that flows in the direction from the user side heat exchangers 52 side to the heat source side heat exchanger 24 is guided to the inlet port of the receiver 26. The check valve 25*b* is connected such that the refrigerant that flows in the direction from the heat source side heat exchanger 24 side to the user source side heat exchanger 52 is guided to the inlet port of the receiver 26. The check valve 25*c* is connected such that the refrigerant that flows from the outlet of the receiver 26 through the heat source side expansion valve 27 can return to the user side heat exchangers 52 side. The check valve 25*d* is connected such that the refrigerant that flows from the outlet of the receiver 26 through the heat source side expansion valve 27 can return to the heat source side heat exchanger 24 side. In this way, the refrigerant that flows into the receiver 26 from the refrigerant circuit between the heat source side heat exchanger 24 and the user side heat exchangers 52 will always flow therein from the, inlet of the receiver 26, and the refrigerant from the outlet of the receiver 26 is returned to the refrigerant circuit between the heat source side heat exchanger 24 and the user side heat exchangers 52.

The cooler 28 is a heat exchanger that serves to cool the refrigerant that is condensed in the heat source side heat exchanger 24 and sent to the user side heat exchangers 52. In addition, a first pressure detection mechanism 31 that serves to detect the refrigerant pressure (refrigerant pressure after pressure reduction) between the user side heat exchangers 52 and the heat source side expansion valve 27 is arranged on the user side heat exchanger 52 side (outlet side) of the cooler 28. In the present embodiment, the first pressure detection mechanism 31 is a pressure sensor. The aperture of the heat source side expansion valve 27 is adjusted so that the refrigerant pressure value measured by the first pressure detection mechanism 31 equals a predetermined pressure value.

The liquid side gate valve 30 and the gas side gate valve 41 are respectively connected to the refrigerant liquid junction line 6 and the refrigerant gas junction line 7. The refrigerant liquid junction line 6 connects the liquid side of the user side heat exchangers 52 of the user units 5 and the liquid side of the heat source side heat exchanger 24 of the heat source unit 2. The refrigerant gas junction line 7 connects the gas side of the user side heat exchangers 52 of the user units 5 and the four way switching valve 23 of the heat source unit 2. Here, as described above, the primary refrigerant circuit 10 of the air conditioner 1 is connected to the user side expansion valve 51, the user side heat exchangers 52, the compressor 21, the oil separator 22, the four way switching valve 23, the heat source side heat exchanger 24, the bridge circuit 25, the receiver 26, the heat source side expansion valve 27, the cooler 28, the liquid side gate valve 30, and the gas side gate valve 41 in this order.

Next, the first auxiliary refrigerant circuit 29 and the second auxiliary refrigerant circuit 42 arranged in the heat source unit 2 will be described below.

The first auxiliary refrigerant circuit 29 is a refrigerant circuit that serves to reduce the pressure on a portion of the refrigerant from the outlet of the receiver 26, introduce the refrigerant to the cooler 28, cause heat to be exchanged with the refrigerant that flows toward the user side heat exchangers 52, and then return the heat exchanged the refrigerant to the intake side of the compressor 21. More specifically, the first auxiliary refrigerant circuit 29 includes a first branching circuit 29*a* that is branched from the circuit that connects the outlet of the receiver 26 and the heat source side expansion valve 27 and extends toward the cooler 28, an auxiliary side expansion valve 29*b* that is arranged on the first branching circuit 29*a*, a first junction circuit 29*c* that joins the outlet of the cooler 28 with the intake side of the compressor 21, and a first temperature detection mechanism 29*d* that is arranged on the first junction circuit 29*c*.

The auxiliary side expansion valve 29*b* is an electric expansion valve that serves to adjust the flow rate of the refrigerant that flows to the cooler 28. The first temperature detection mechanism 29*d* is a thermistor that is provided in order to measure the temperature of the refrigerant from the outlet of the cooler 28. Then, the aperture of the auxiliary side expansion valve 29*b* is adjusted based upon the temperature of the refrigerant that is measured by the first temperature detection mechanism 29*d*. More specifically, the aperture is adjusted by means of superheating control between the first temperature detection mechanism 29*d* and the refrigerant temperature of the heat source side heat exchanger 24. In this way, the refrigerant from the outlet of the cooler 28 can completely evaporate and return to the intake side of the compressor 21.

The second auxiliary refrigerant circuit 42 is arranged between the four way switching valve 23 of the primary refrigerant circuit 10 and the user side heat exchangers 52, and is a refrigerant circuit that is capable of condensing a portion of the refrigerant that is compressed in the compressor 21 and sent to the user side heat exchangers 52, and then returning that refrigerant to the main refrigerant circuit 10. The second auxiliary refrigerant circuit 42 primarily includes a second branching circuit 42*a* that serves to branch from the primary refrigerant circuit 10 a portion of the refrigerant that is compressed in the compressor 21 and sent to the user side heat exchangers 52, a condenser 42*b* that is capable of condensing the branched refrigerant, and a second junction circuit 42*c* that is capable of returning the branched refrigerant to the primary refrigerant circuit 10. In the present embodiment, the condenser 42*b* is a heat exchanger that exchanges heat between air that serves as the heat source and the refrigerant.

In addition, a condenser open/close valve 42*d* is arranged on the second junction circuit 42*c* side of the condenser 42*b*, and serves to propagate the flow of the refrigerant to the condenser 42*b* and to cut the flow of the refrigerant thereto. The condenser open/close valve 42*d* is an electric expansion valve that is capable of adjusting the flow rate of the refrigerant that flows into the condenser 42*b*.

In addition, a second pressure detection mechanism 42*e* is arranged on the second junction circuit 42*c*, and serves to detect the pressure of the refrigerant on the second junction circuit 42*c* side (outlet side) of the condenser 42*b*. In the present embodiment, the second pressure detection mechanism 42*e* is a pressure sensor. The aperture of the condenser open/close valve 42*d* is adjusted so that the refrigerant pressure value measured by the second pressure detection mechanism 42*e* is equal to or less than a predetermined pressure value.

Furthermore, the second auxiliary refrigerant circuit 42 further includes a bypass circuit 42*f* that is capable of bypassing the condenser 42*b* and allowing the refrigerant to flow from the compressor 21 toward the user side heat exchangers 52. Then, a check mechanism 44 that only permits flow from the user side heat exchangers 52 to the condenser 21 is provided between the connector that connects the second branching circuit 42*a* to the main refrigerant circuit 10 and the connector that connects the second junction circuit 42*c* to the main refrigerant circuit 10. In the present embodiment, the check mechanism 44 is a check valve. A capillary tube 42*g* that corresponds to a pressure drop in the condenser open/close valve 42*d* and the condenser 42*b* is arranged in the bypass circuit 42*f* so that the flow rate of the refrigerant that flows into the condenser 42*b* can be maintained by adjusting the aperture of the condenser open/close valve 42*d*.

(4) Operation of the Air Conditioner

Next, the operation of the air conditioner 1 will be described with reference to FIGS. 1-3. Here, FIG. 2 is a Mollier diagram of a refrigeration cycle when the air conditioner 1 performs cooling operations, and FIG. 3 is a Mollier diagram of a refrigeration cycle when the air conditioner 1 performs heating operations.

① Cooling Operations

First, cooling operations will be described. During cooling operations, the four way switching valve 23 is in the state shown by the solid lines in FIG. 1, i.e., the discharge side of the compressor 21 is connected to the gas side of the heat source side heat exchanger 24, and the intake side of the compressor 21 is connected to the gas side of the user side heat exchangers 52. In addition, the liquid side gate valve 30 and the gas side gate valve 41 are opened, and the aperture of the user side expansion valve 51 is adjusted such that the refrigerant pressure is reduced. The aperture of the heat source side expansion valve 27 is adjusted in order to control the refrigerant pressure in the first pressure detection mechanism 31 at a predetermined pressure value. The aperture of the auxiliary side expansion valve 29*b* is adjusted by superheating control between the first temperature detection mechanism 29*d* and the refrigerant temperature of the heat source side heat exchanger 24. Here, the condenser open/close valve 42*d* of the second auxiliary refrigerant circuit 42 is closed. In this way, the refrigerant that flows from the user side heat exchangers 52 to the compressor 21 will primarily flow through the check mechanism 44.

Figure 2:
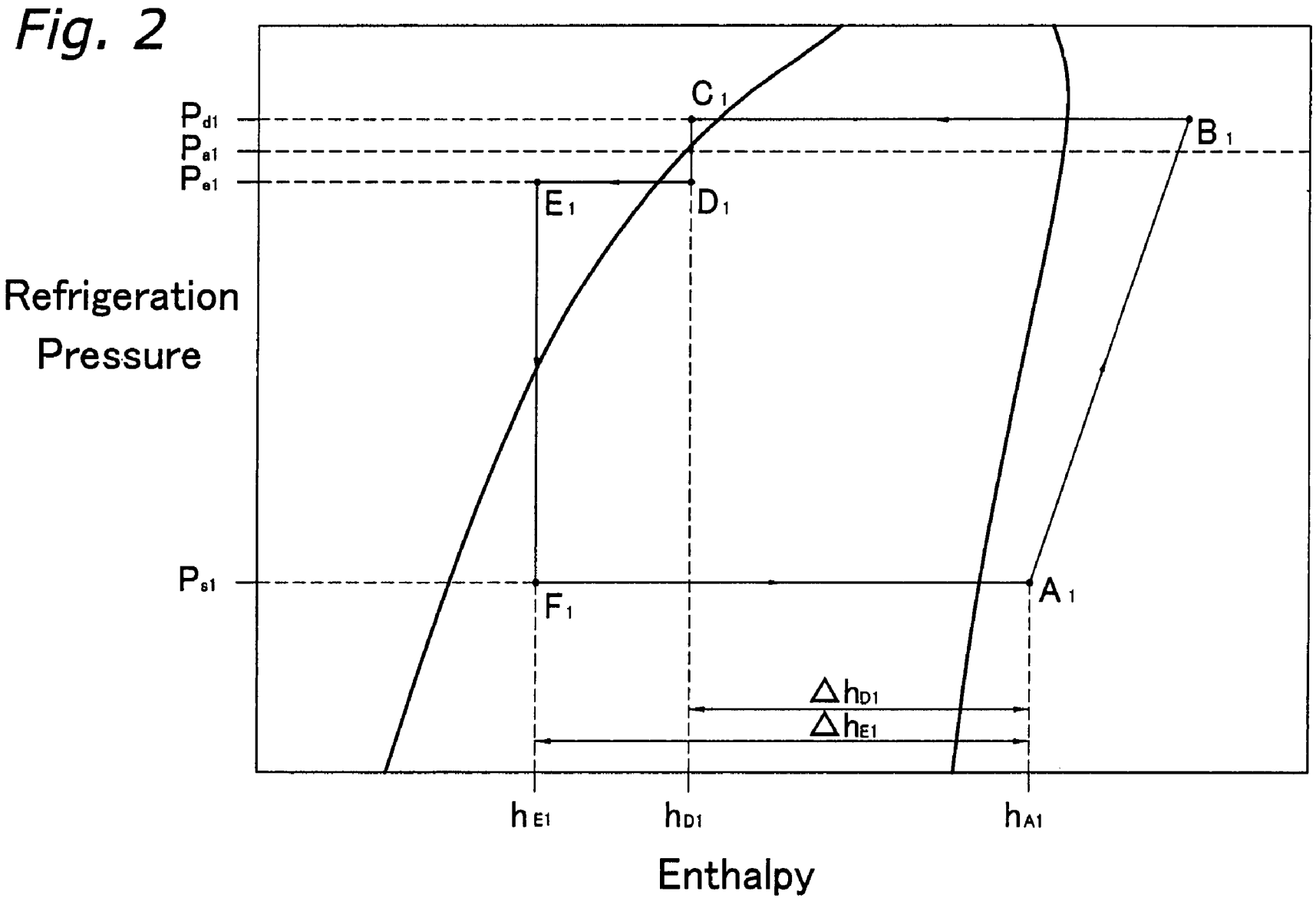
FIG. 2 is a Mollier diagram of a refrigeration cycle of an air conditioner during cooling operations.
Figure 3:
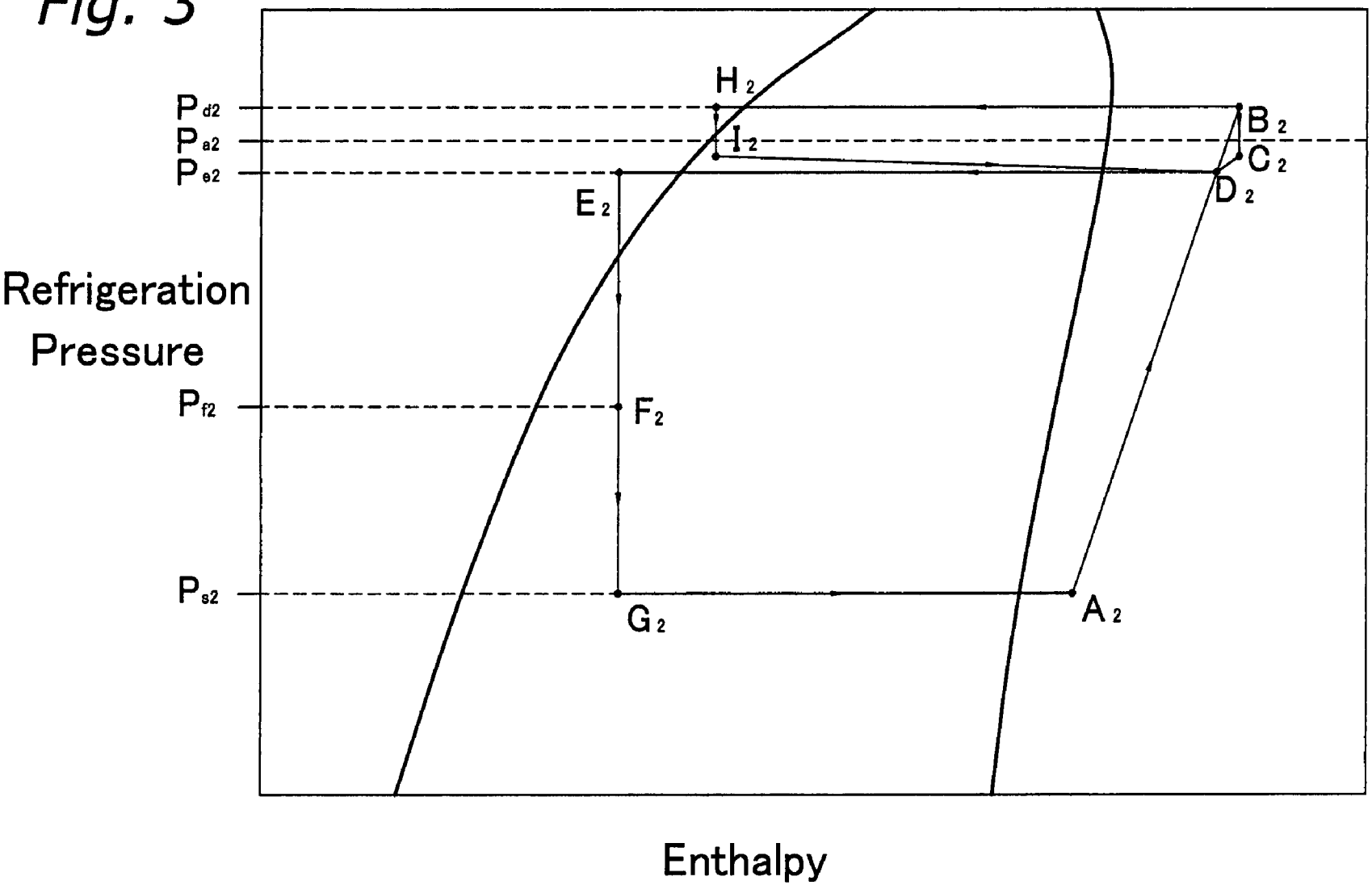
FIG. 3 is a Mollier diagram of a refrigeration cycle of an air conditioner during heating operations.

When a fan (not shown in the figures) in the heat source unit 2, a fan (not shown in the figures) in the user side units 5, and the compressor 21 are started with the primary refrigerant circuit 10 and the auxiliary refrigerant circuits 29, 42 in this state, refrigerant gas is taken in by the compressor 21 and compressed from a pressure $P_{s1}$ to a pressure $P_{d1}$, and then the mixture of oil and the refrigerant gas are sent to the oil separator 22 and the oil is separated therefrom (refer to points $A_1$, $B_1$ in FIG. 2). After that, the compressed refrigerant gas is sent to the heat source side heat exchanger 24 via the four way switching valve 23, exchanges heat with outdoor air, and is condensed (refer to the point $C_1$ in FIG. 2). The condensed refrigerant liquid flows into the receiver 26 via the check valve 25*b* of the bridge circuit 25. Then, after the refrigerant liquid is temporarily collected in the receiver 26, the pressure $P_{d1}$ that is higher than a maximum allowable operating pressure $P_{a1}$ of the refrigerant liquid junction line 6 is reduced to a pressure $P_{e1}$ that is lower than the pressure $P_{a1}$ in the heat source side expansion valve 27 (refer to the point $D_1$ in FIG. 2). When this occurs, the reduced pressure refrigerant is in the gas-liquid phase. The reduced pressure refrigerant exchanges heat in the cooler 28 with the refrigerant that flows on the first auxiliary refrigerant circuit 29 side thereof and is cooled in order to obtain a sub-cooled liquid (refer to the point $E_1$ in FIG. 2), which is then sent to the user units 5 via the liquid side gate valve 30 and the refrigerant liquid junction line 6. Then, the refrigerant liquid that is sent to the user units 5 is reduced in pressure by the user side expansion valve 51 (refer to the point $F_1$ in FIG. 2), and then exchanges heat with indoor air in the user side heat exchangers 52 and evaporated (refer to the point $A_1$ in FIG. 2). The evaporated refrigerant gas is again taken into the compressor 21 via the refrigerant gas junction line 7, the gas side gate valve 41, the check mechanism 44, and the four way switching valve 23. Here, the pressure measured by the first pressure detection mechanism 31 is controlled to a predetermined pressure value (i.e., pressure $P_{e1}$) by adjusting the aperture of the heat source side expansion valve 27. In addition, a portion of the refrigerant liquid that was collected in the receiver 26 is reduced in pressure to a point close to the pressure $P_{s1}$ by means of the auxiliary side expansion valve 29*b* arranged in the first branching circuit 29*a* of the first auxiliary refrigerant circuit 29, is then introduced into the cooler 28, and then exchanges heat with the refrigerant that flows on the primary refrigerant circuit 10 side thereof and is evaporated. Then, the evaporated refrigerant is returned to the intake side of the compressor 21 via the first junction circuit 29*c*. In this way, cooling operations will be carried out in which the refrigerant pressure will be reduced to the pressure $P_{e1}$ that is lower than the maximum allowable operating pressure $P_{a1}$ of the refrigerant liquid junction line 6, and the refrigerant liquid will be placed in a sufficiently sub-cooled state and supplied to the user side heat exchangers 52.

② Heating Operations

Next, heating operations will be described. During heating operations, the four way switching valve 23 is in the state shown by the broken lines in FIG. 1, i.e., the discharge side of the compressor 21 is connected to the gas side of the user side heat exchangers 52, and the intake side of the compressor 21 is connected to the gas side of the heat source side heat exchanger 24. In addition, the liquid side gate valve 30 and the gas side gate valve 41 are opened, and the apertures of the user side expansion valve 51 and the heat source side expansion valve 25 is adjusted such that the refrigerant pressure is reduced. Here, the auxiliary side expansion valve 29*b* is closed, and the first auxiliary refrigerant circuit is not used. The aperture of the condenser open/close valve 42*d* of the second auxiliary refrigerant valve 42 is adjusted in order to control the refrigerant pressure in the second pressure detection mechanism 42*e* to a predetermined pressure value.

When a fan (not shown in the figures) in the heat source unit 2, a fan (not shown in the figures) in the user side units 5, and the compressor 21 are started with the primary refrigerant circuit 10 and the auxiliary refrigerant circuits 29, 42 in this state, refrigerant gas is taken in by the compressor 21 and compressed from a pressure $P_{s2}$ to a pressure $P_{d2}$, and then the mixture of oil and the refrigerant gas are sent to the oil separator 22 and the oil is separated therefrom (refer to points $A_2$, $B_2$ in FIG. 3). After that, the compressed refrigerant gas is sent to the user units 5 via the four way switching valve 23. Here, the flow of the refrigerant gas is cut by means of the check mechanism 44 arranged between the four way switching valve 23 and the gas side gate valve 41, and the refrigerant gas flows to the user units 5 side via the second auxiliary refrigerant circuit 42.

After the refrigerant gas flows into the second branching circuit 42*a*, it is branched into a flow that returns to the second junction circuit 42*c* via the bypass circuit 42*f* of the second auxiliary refrigerant circuit 42 and a flow that returns to the junction circuit 42*c* via the condenser 42*b* and the condenser open/close valve 42*d*. The refrigerant gas that flows in the bypass circuit 42*f* is reduced in pressure somewhat by the capillary 42*g* and returns to the second junction circuit 42*c* (refer to point $C_2$ in FIG. 3). On the other hand, the flow rate of the refrigerant gas that flows into the condenser 42*b* is determined in accordance with the aperture of the condenser open/close valve 42*d*, the refrigerant gas exchanges heat with outdoor air and is condensed to refrigerant liquid, and then returns to the second junction circuit 42*c* (refer to point $H_2$, $I_2$ of FIG. 3). The mixed refrigerant gas that returns to the second junction circuit 42*c* is reduced in pressure from a pressure $P_{d2}$ of the refrigerant gas that flows in the second branching circuit 42*a* to a pressure $P_{e2}$ that is lower than a maximum allowable operating pressure $P_{a2}$ of the refrigerant gas junction line 7, by means of a pressure reduction effect caused by the reduction of the volume of the refrigerant gas in response to the condensation of the refrigerant gas in the condenser 42*b*, and is then returned to the main refrigerant circuit 10 and sent to the user side heat exchangers 52 (refer to the point $D_2$ in FIG. 3). Here, the aperture of the condenser open/close valve 42*d* is adjusted so that the refrigerant pressure measured by the second pressure detection mechanism 42*e* arranged in the second junction circuit 42*c* equals the pressure $P_{e2}$, and the amount of condensation of the refrigerant gas in the condenser 42*b* is controlled, i.e., the pressure of the refrigerant gas sent to the user side heat source unit 52 is controlled. In addition, the state of the refrigerant gas after it has been reduced in pressure by pressure reduction control (point $D_2$ in FIG. 3) is near the line indicating the degree of compression caused by the compression 21 (the line connecting point $A_2$ and point $B_2$ in FIG. 3). This indicates that a refrigerant temperature can be obtained by pressure reduction control that is approximately the same as the temperature of the refrigerant when the refrigerant gas is compressed up to pressure $P_{e2}$ by the compressor 21. In this way, the refrigerant gas that is sent to the user side heat exchangers 52 is sent at a refrigerant temperature that is the same as that when the refrigerant gas is compressed up to pressure $P_{e2}$ by means of the compressor 21.

As noted above, after gas that is to be sent to the user side heat exchangers 52 is reduced in pressure down to pressure $P_{e2}$, it is returned to the main refrigerant circuit 10 and sent to the user units 5 via the gas side gate valve 41 and the refrigerant gas junction line 7. Then, the refrigerant gas sent to the user unit 5 exchanges heat with indoor air by means of the user side heat exchangers 52 and is condensed (refer to the point $E_2$ in FIG. 3). After the condensed refrigerant liquid is reduced in pressure down to a pressure $P_{f2}$ in the user side expansion valve 51 (refer to the point $F_2$ of FIG. 3), it is sent to the heat source unit 2 via the refrigerant liquid junction line 6. Then, the refrigerant liquid that is sent to the heat source unit 2 is reduced in pressure down to pressure $P_{s2}$ by the heat source side expansion valve 25 (refer to point $G_2$ in FIG. 3), and then exchanges heat with outdoor air in the heat source side heat exchanger 24 and evaporated (refer to the point $A_2$ in FIG. 3). The evaporated refrigerant gas is again taken into the compressor 21 via the four way switching valve 23. In this way, heating operations are carried out in which the refrigerant pressure is reduced to a pressure $P_{e2}$ that is lower than the maximum allowable operating pressure $P_{a2}$ of the refrigerant gas junction line 7, and the refrigerant gas is adjusted to a refrigerant temperature that is the same as that obtained when the refrigerant gas is compressed by the compressor 21 and then provided to the user side heat exchangers 52.

(5) Special Characteristics of the Air Conditioner of the Present Embodiment

As described below, the special characteristics of the air conditioner 1 of the present embodiment are as follows:

① Special Characteristics During Cooling Operations

In the air conditioner 1 of the present embodiment, after the refrigerant condensed in the heat source side heat exchanger 24 is reduced in pressure by the heat source side expansion valve 27 and cooled by the cooler 28, it can be sent to the user side heat exchangers 52. Because of this, the refrigerant to be sent to the user side heat exchangers 52 can be reduced in pressure and can be kept in the sub-cooled state. In addition, the pressure of the refrigerant can be adjusted to a predetermined pressure value (pressure $P_{e1}$ in FIG. 2) between the heat source side expansion valve 27 and the user side heat exchangers 52, because the pressure of the refrigerant can be detected by means of the first pressure detection mechanism 31 after it has been reduced in pressure in the heat source side heat exchanger 27. Thus, when the refrigerant condensed in the heat source side heat exchanger 24 is reduced in pressure and sent to the user side heat exchangers 52, the refrigerant pressure can be stably controlled, and a reduction in the cooling ability of the user side heat exchangers 52 can be prevented. In the present embodiment, as shown in FIG. 2, the change in enthalpy $h_{E1}$, after the reduction in pressure in the heat source side expansion valve 27 is larger than the change in enthalpy $h_{D1}$ before the reduction in pressure therein, and thus the cooling ability per refrigerant flow rate unit will increase.

In addition, in the air conditioner 1, the first pressure detection mechanism 31 is a pressure sensor, and thus during cooling operations, the refrigerant pressure between the heat source side expansion valve 27 and the user side heat exchangers 52 can be continuously monitored, and the reliability of the refrigerant pressure will be high.

Furthermore, with the air conditioner 1, the pressure of the refrigerant liquid condensed by the heat source heat exchanger 24 can be reduced down to a pressure $P_{e1}$ that is lower than the maximum allowable operating pressure $P_{a1}$ of the refrigerant liquid junction line 6 by means of the heat source side expansion valve 27 and sent to the user side heat exchangers 52, and thus as in the present embodiment, a refrigerant having saturation pressure characteristics that are higher than those of R407C can be used as the operating refrigerant, even in situations in which the maximum allowable operating pressure of the lines and devices that form the circuit between the heat source side expansion valve 27 and the user side heat exchangers 52 only extends up to the saturation pressure of R407C at a standard temperature. Thus, in the present embodiment, the refrigerant liquid junction line 6 of a preexisting air conditioner that used R22 or R407C as the operating refrigerant can be reused, even in situations in which the newly constructed air conditioner 1 uses a refrigerant having saturation pressure characteristics that are higher than those of R407C as the operating refrigerant.

In addition, the air conditioner 1 includes a receiver 26 that serves to collect the refrigerant condensed in the heat source side heat exchanger 24 and send the refrigerant to the heat source side expansion valve 27, and thus the refrigerant liquid condensed by the heat source side heat exchanger 24 is not stored inside the heat source side heat exchanger 24 as is, and the discharge therefrom can be facilitated. Thus, pooling of the refrigerant liquid can be reduced in the heat source side heat exchanger 24, and heat exchange can be facilitated.

Furthermore, with the air conditioner 1, refrigerant liquid can be sent to the user side heat exchangers 52 in the sub-cooled state, and thus as in the present embodiment, the refrigerant can be kept in the liquid state and it will be difficult to produce an unbalanced refrigerant flow, even in situations in which the refrigerant is branched to a plurality of user units 5 or there is a difference in elevation from the heat source unit 2 to the user units 5.

In addition, with the air conditioner 1, the cooler 28 is a heat exchanger that serves as a cooling source for the refrigerant that flows inside the primary refrigerant circuit 10, and thus another cooling source is unnecessary. In the present embodiment, the refrigerant that is introduced into the cooler 28 by means of the first auxiliary refrigerant circuit 29 serves as a cooling source. The first auxiliary refrigerant circuit 29 uses a portion of the refrigerant condensed by the heat source side heat exchanger 24 as a cooling source for the cooler, and reduces the pressure thereof to a point in which the refrigerant can return to the intake side of the compressor 21. Because the cooling source can attain a temperature that is sufficiently lower than that of the refrigerant that flows in the primary refrigerant circuit 10 side, the refrigerant that flows in the primary refrigerant circuit 10 side can be cooled to the sub-cooled state. Furthermore, the aperture of the auxiliary side expansion valve 29*b* can be adjusted based upon the refrigerant temperature measured by the first temperature detection mechanism 29*d*, and thus the flow rate of the refrigerant that flows in the cooler 28 can be adjusted, because the first auxiliary refrigerant circuit 29 includes the auxiliary side expansion valve 29*b* and the first temperature detection mechanism 29*d* that is arranged at the outlet of the cooler 28. Thus, the refrigerant that flows in the primary refrigerant circuit 10 can be reliably cooled, and the refrigerant can be returned to the condenser 21 after it has been evaporated at the outlet of the cooler 28.

② Special Characteristics During Heating Operations

During heating operations with the air conditioner 1 of the present embodiment, a portion of the refrigerant that is compressed in the compressor 21 and sent to the user side heat exchangers 52 can be condensed by the second auxiliary refrigerant circuit 42 to thereby reduce the pressure of the refrigerant that is sent to the user side heat exchangers 52. This allows the pressure of the refrigerant that is sent to the user side heat exchangers 52 to be stably controlled. In the present embodiment, the pressure of the refrigerant can be reliably reduced with good response because the second auxiliary refrigerant circuit 42 includes the condenser 42*b*, the refrigerant that is sent to the user side heat exchangers 52 by the condenser 42*b* is condensed, and the pressure thereof is reduced by reducing the volume of the refrigerant gas. In addition, the second auxiliary refrigerant circuit 42 can also propagate/cut off the flow of refrigerant to the condenser 42*b* at the appropriate time because it includes the condenser open/close valve 42*d* that can propagate/cut off the flow of refrigerant to the condenser 42*b*. Furthermore, the pressure of the refrigerant that is sent to the user side heat exchangers 52 can be stably controlled because the second pressure detection mechanism 42*e* that serves to detect the refrigerant pressure between the condenser 42*b* and the user side heat exchangers 52 is arranged in the second junction circuit 42*c* of the second auxiliary refrigerant circuit 42.

In addition, when the pressure control is carried out by the second auxiliary refrigerant circuit 42, the state of the refrigerant gas after it has been reduced in pressure by pressure reduction control (refer to point $D_2$ in FIG. 3) is near the line indicating the degree of compression caused by the compression 21 (the line connecting point $A_2$ and point $B_2$ in FIG. 3). The desired heating load will be easily maintained by means of this pressure reduction control, because the temperature of the refrigerant gas sent to the user side heat exchangers 52 can be set to a temperature that is the same as that when the refrigerant gas is compressed up to a pressure $P_{e2}$ by the compressor 21.

Furthermore, a refrigerant can flow through the second auxiliary refrigerant circuit 42 when it is sent from the compressor 21 to the user side heat exchangers 52, and can flow through the check mechanism 44 of the primary refrigerant circuit 10 when it is sent from the user side heat exchangers 52 to the compressor 21, because the air conditioner 1 further includes the bypass circuit 42*f* arranged in the second auxiliary refrigerant circuit 42 and the check mechanism 44 arranged in the primary refrigerant circuit 10. This allows the flow path of the refrigerant gas to be switched during cooling operations and heating operations.

In addition, as shown in FIG. 3, a refrigerant having saturation pressure characteristics that are higher than those of R407C can be used as the operating refrigerant in the air conditioner 1, even in situations like the present embodiment in which the maximum allowable operating pressure of the lines and devices that form the circuit between the compressor 21 and the user side heat exchangers 52 only extends up to the saturation pressure of R407C at a normal temperature, because the refrigerant gas sent to the user side heat exchangers 52 can be reduced in pressure down to a pressure $P_{e2}$ that is lower than the maximum allowable operating pressure $P_{a2}$ of the refrigerant gas junction line 7 by condensing a portion of the refrigerant gas that is sent from the compressor 21 to the user side heat exchangers 52 by means of the second auxiliary refrigerant circuit 42. Thus, in the present embodiment, the refrigerant gas junction line 7 of a preexisting air conditioner that used R22 or R407C as the operating refrigerant can be reused, even in situations in which the newly constructed air conditioner 1 uses a refrigerant having saturation pressure characteristics that are higher than those of R407C as the operating refrigerant.

(6) Modification 1

Figure 4:
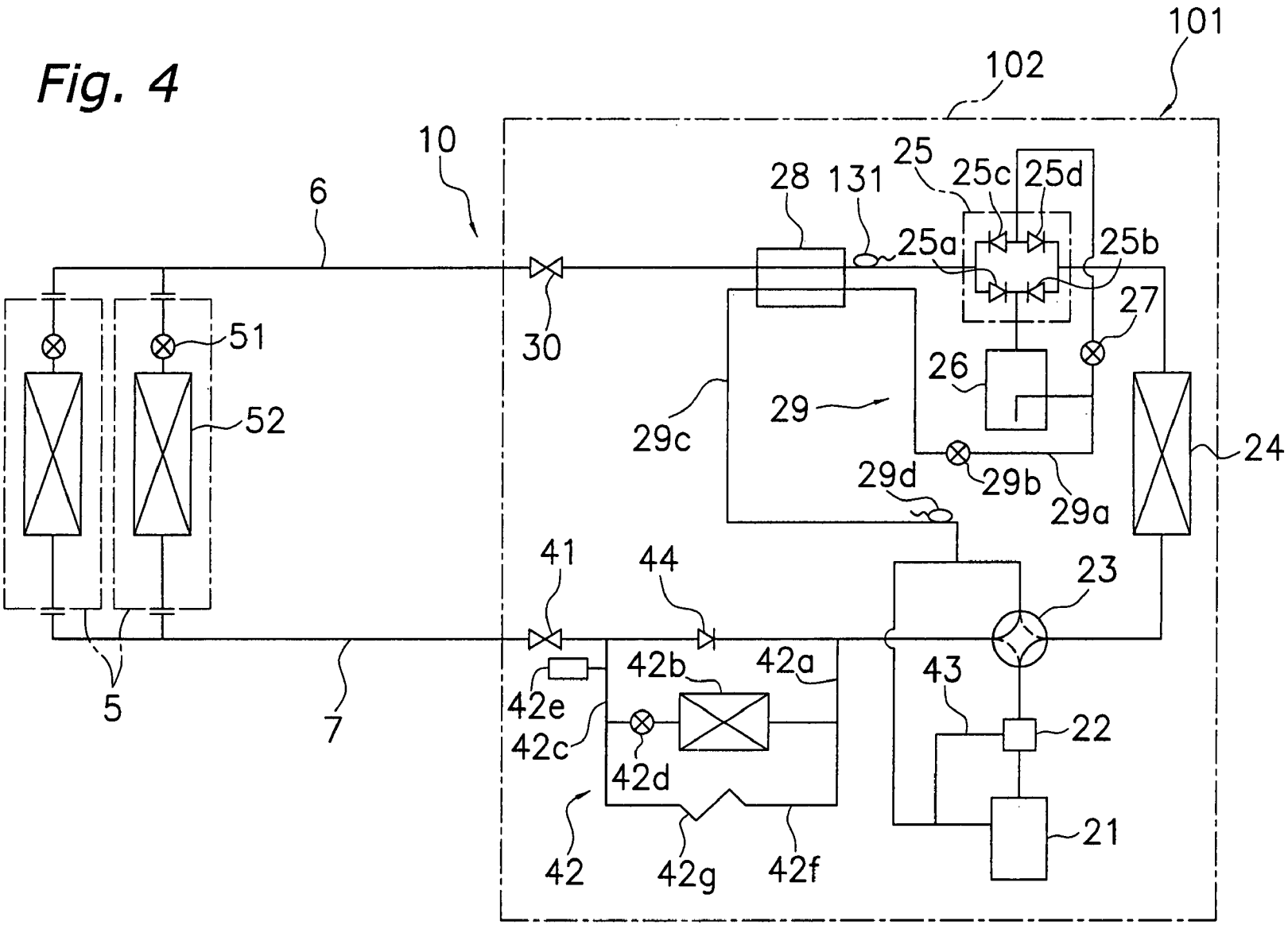
FIG. 4 is a schematic diagram of a first modification of the refrigerant circuit of the air conditioner of the present invention.

In the aforementioned embodiment, a first pressure detection mechanism 31 that includes a pressure sensor is arranged between the cooler 28 inside the heat source unit 2 and the liquid side gate valve 30 of the air conditioner 1. However, as shown in FIG. 4, an air conditioner 101 may include a heat source unit 102 in which a first pressure detection mechanism 131 that includes a thermistor is arranged between a bridge circuit 25 and the cooler 28. Note that a description of the other structure of the air conditioner 101 will be omitted because it is identical with that of the air conditioner 1.

In the air conditioner 101, the refrigerant condensed by the heat source side heat exchanger 24 is reduced in pressure by the heat source side expansion valve 27 to form a saturated refrigerant liquid or a two-phase refrigerant, sent to the cooler 28 and cooled to a sub-cooled state, and then sent to the user side heat exchangers 52. Here, the first pressure detection mechanism 131 that includes a thermistor and arranged between the heat source side expansion valve 27 and the cooler 28 measures the temperature of the refrigerant after the pressure thereof has been reduced by the heat source side expansion valve 27. The measured refrigerant temperature is the temperature of refrigerant in the saturated state or the gas-liquid state, and thus the saturation pressure of the refrigerant can be determined from this temperature. In other words, the pressure of the refrigerant after pressure reduction in the heat source side expansion valve 27 can be indirectly measured by means of the first pressure detection mechanism 131. Like in the aforementioned embodiment, this allows the refrigerant pressure between the heat source side expansion valve 27 and the user side heat exchangers 52 to be stably controlled.

(7) Modification 2

Figure 5:
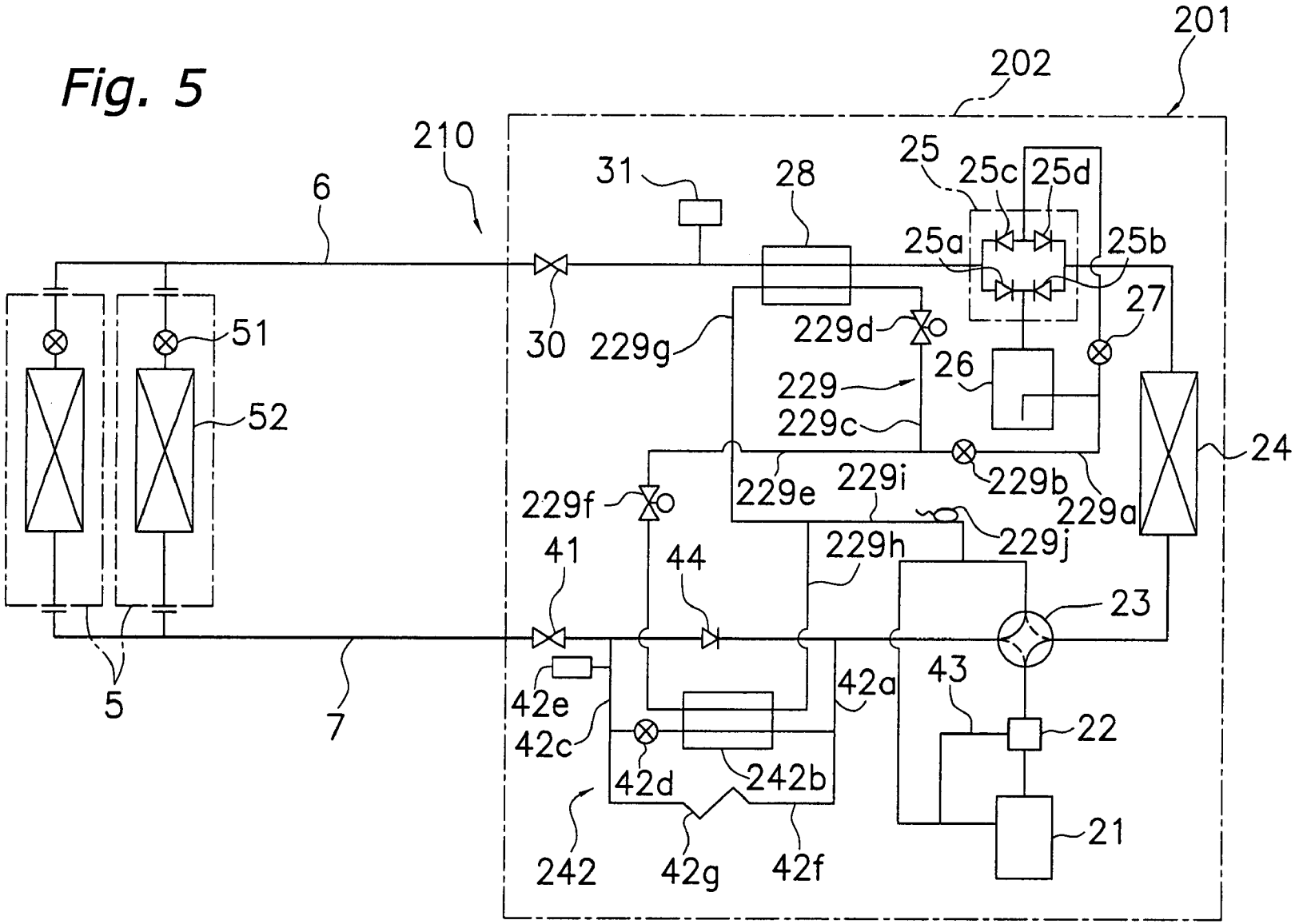
FIG. 5 is a schematic diagram of a second modification of the refrigerant circuit of the air conditioner of the present invention.

In the aforementioned embodiment, the second auxiliary refrigerant circuit 42 inside the heat source unit 2 of the air conditioner 1 includes an air cooling type of condenser 42*b*. However, as shown in FIG. 5, an air conditioner 201 may include a heat source unit 202 in which a second auxiliary refrigerant circuit 242 is arranged, and having a condenser 242*b* that uses the refrigerant flowing in a primary refrigerant circuit 210 as a cooling source. Here, the cooling source of the condenser 242*b* is the refrigerant that is reduced in pressure by an auxiliary side expansion valve 229*b* of a first auxiliary refrigerant circuit 229, and is the same as the cooling source of the cooler 28.

The first auxiliary refrigerant circuit 229 is primarily formed from a first branching circuit 229*a* that is branched from the circuit that connects the outlet of the receiver 26 and the heat source side expansion valve 27 and extends toward the cooler 28 and the condenser 242*b*, and a first junction circuit 229*c* that joins the outlet of the cooler 28 and the outlet of the condenser 242*b* to the intake side of the compressor 21. The first branching circuit 229*a* includes a primary branching circuit 229*a*, an auxiliary side expansion valve 229*b* that is arranged in the primary branching circuit 229*a*, a cooler side branching circuit 229*c* that is arranged on the downstream side of the auxiliary side expansion valve 229*b* and connected to the inlet of a cooler 28, and a condenser side branching circuit 229*e* that is arranged on the downstream side of the auxiliary side expansion valve 229*b* and connected to the inlet of a condenser 242*b*. The cooler side branching circuit 229*c* includes a branching open/close valve 229*d* that serves to propagate/cut off the flow of the refrigerant to the cooler 28. In addition, the condenser side branching circuit 229*e* includes a branching open/close valve 229*f* that serves to propagate/cut off the flow of the refrigerant to the condenser 242*b*. The first junction circuit 229*c* includes a primary junction circuit 229*i* that joins with the intake side of the compressor 21, a cooler side junction circuit 229*c* that joins the outlet of the cooler 28 with the primary junction circuit 229*i*, a condenser side joining circuit 229*h* that joins the outlet of the condenser 242*b* to the primary junction circuit 229*i*, and a first temperature detection mechanism 229*j* that is arranged in the primary junction circuit 229*i*. Note that a description of the other structure of the air conditioner 201 will be omitted because it is identical with that of the air conditioner 1.

After the branching open/close valve 229*d* is opened so that the cooler 28 can be used, and the branching open/close valve 229*f* is closed so that the condenser 242*b* is not used, the air conditioner 201 can conduct cooling operations like with the air conditioner 1. In addition, after the branching open/close valve 229*d* is closed so that the cooler 28 is not used, and the branching open/close valve 229*f* is opened so that the condenser 242*b* can be used, the air conditioner 201 can conduct heating operations like with the air conditioner 1. In other words, pressure control of the primary refrigerant circuit 210 can be stably performed by switching between the branching open/close valve 229*d*, 229*f* in accordance with the operational mode.

(8) Other Embodiments

Although an embodiment of the present invention was described above based upon the figures, the specific configuration of the present invention is not limited to this embodiment, and can be modified within a range that does not depart from the essence of the invention.

① Although the heat source units used in the air conditioner in the aforementioned embodiment are the air cooling type which use outdoor air as a heat source, water cooling types or ice storage types of heat source units may also be used.

② In the aforementioned embodiment, a pressure sensor is used in the second pressure detection mechanism, however a pressure switch may also be used. This allows a faster control response. In addition, the condenser open/close valve need not be an electric expansion valve, but rather a solenoid valve that has no restriction function. Thus, although a smooth control response cannot be obtained compared to when an electric expansion valve is used, a prompt control response can be obtained.

③ In the aforementioned embodiment, a capillary tube is arranged in the bypass circuit, however the diameter of the line that forms the bypass circuit may simply be reduced so that the pressure drop can be maintained.

④ In the aforementioned embodiment, an operation was described in which the discharge pressure of the compressor is always higher than the pressure in the refrigerant liquid junction line and the refrigerant gas junction line. However, a control that is combined with capacity control by means of inverter control and the like of the compressor is also possible. For example, possible operations include controlling the refrigerant pressure measured by the discharge pressure sensor and the like of the compressor by means of capacity control of the compressor such that the pressure thereof is lower than the maximum allowable operating pressure of the refrigerant liquid junction line and the refrigerant gas junction line, opening the heat source side expansion valve and the condenser open/close valve to reduce the refrigerant pressure only when the pressure detected by the first and second pressure detection mechanisms approaches the maximum allowable operating pressure of the refrigerant liquid junction line and the refrigerant gas junction line, and the like.

⑤ In the aforementioned embodiment, the configuration described is one in which a preexisting heat source unit and user units of an air conditioner that used R22 R407C, or the like are replaced with the heat source unit 2 and the user units 5, and the preexisting refrigerant liquid junction line and the refrigerant gas junction line that can only operate at or below the saturation pressures of R22, R407C, and the like are used as is. However, the aforementioned embodiment is not limited thereto. For example, even in situations in which a new air conditioner is to be installed, there will be times in which a refrigerant gas junction line and a refrigerant liquid junction line that use a refrigerant having high saturation pressure characteristics such as R410A, R32, and the like cannot be prepared, and thus, like in the aforementioned embodiment, it is possible to adapt the present invention to these situations. Thus, it will be possible to construct an air conditioner that employs a refrigerant gas junction line and a refrigerant liquid junction line that can be prepared on-site, and which uses a refrigerant having high saturation pressure characteristics such as R410A, R32, and the like as the operating refrigerant.

INDUSTRIAL APPLICABILITY

According to the present invention, the pressure of refrigerant to be sent to a user side heat exchanger can be stably controlled because the refrigerant pressure can be reduced by condensing a portion of the refrigerant compressed in the condenser and sent to the user side heat exchanger.

What is claimed is:

1. A refrigeration device comprising:

a refrigerant circuit having a compressor, a heat source side heat exchanger arranged to supply refrigerant passing through the heat source side heat exchanger to the compressor, and a user side heat exchanger arranged to receive the refrigerant that is compressed in the compressor; and a condenser arranged between the compressor and the user side heat exchanger, the condenser being configured to condense a portion of the refrigerant that is compressed in the compressor and that is sent to the user side heat exchanger, the refrigerant having saturation pressure characteristics that are higher than those of R407C.

2. A refrigeration device comprising:

a refrigerant circuit having a compressor, a heat source side heat exchanger arranged to supply refrigerant passing through the heat source side heat exchanger to the compressor, and a user side heat exchanger arranged to receive the refrigerant that is compressed in the compressor;

a condenser arranged between the compressor and the user side heat exchanger, the condenser being configured to condense a portion of the refrigerant that is compressed in the compressor and that is sent to the user side heat exchanger; and a check mechanism connected between the compressor and the user side heat exchanger to allow only the refrigerant to flow from the user side heat exchanger to the compressor, the condenser being connected to the refrigerant circuit via a branching circuit that propagates the flow of the refrigerant cut-off by the check mechanism from the compressor to the user side heat exchanger, and a junction circuit that sends the refrigerant condensed in the condenser to the user side heat exchanger.

3. A refrigeration device comprising:

a refrigerant circuit having a compressor, a heat source side heat exchanger arranged to supply refrigerant passing through the heat source side heat exchanger to the compressor, and a user side heat exchanger arranged to receive the refrigerant that is compressed in the compressor;

a condenser arranged between the compressor and the user side heat exchanger, the condenser being configured to condense a portion of the refrigerant that is compressed in the compressor and that is sent to the user side heat exchanger; and a bypass circuit that can bypass the condenser and propagate refrigerant from the compressor to the user side heat exchanger.

4. The refrigeration device according to claim 1, further comprising a pressure detection mechanism is provided to detect the pressure of the refrigerant that flows between the condenser and the user side heat exchanger.

5. The refrigeration device according to claim 3, further comprising an open/close mechanism configured to adjust the amount of the refrigerant that flows into the condenser.

6. The refrigeration device according to claim 1, wherein the condenser is a heat exchanger that uses the refrigerant that flows inside the refrigerant circuit as a cooling source.

7. The refrigeration device according to claim 2, further comprising a pressure detection mechanism is provided to detect the pressure of the refrigerant that flows between the condenser and the user side heat exchanger.

8. The refrigeration device according to claim 2, further comprising a bypass circuit that can bypass the condenser and propagate refrigerant from the compressor to the user side heat exchanger.

9. The refrigeration device according to claim 8, further comprising an open/close mechanism configured to adjust the amount of the refrigerant that flows into the condenser.

10. The refrigeration device according to claim 2, wherein the condenser is a heat exchanger that uses the refrigerant that flows inside the refrigerant circuit as a cooling source.

11. The refrigeration device according to claim 2, wherein the refrigerant has saturation pressure characteristics that are higher than those of R407C.

12. A refrigeration device comprising:

a refrigerant circuit having a compressor, a heat source side heat exchanger arranged to supply refrigerant passing through the heat source side heat exchanger to the compressor, and a user side heat exchanger arranged to receive the refrigerant that is compressed in the compressor;

a condenser arranged between the compressor and the user side heat exchanger, the condenser being configured to condense a portion of the refrigerant that is compressed in the compressor and that is sent to the user side heat exchanger;

a pressure detection mechanism provided to detect the pressure of the refrigerant that flows between the condenser and the user side heat exchanger; and a bypass circuit that can bypass the condenser and propagate refrigerant from the compressor to the user side heat exchanger.

13. The refrigeration device according to claim 12, further comprising an open/close mechanism configured to adjust the amount of the refrigerant that flows into the condenser.

14. A refrigeration device comprising:

a refrigerant circuit having a compressor, a heat source side heat exchanger arranged to supply refrigerant Passing through the heat source side heat exchanger to the compressor, and a user side heat exchanger arranged to receive the refrigerant that is compressed in the compressor;

a condenser arranged between the compressor and the user side heat exchanger, the condenser being configured to condense a portion of the refrigerant that is compressed in the compressor and that is sent to the user side heat exchanger; and a pressure detection mechanism provided to detect the pressure of the refrigerant that flows between the condenser and the user side heat exchanger, the condenser being a heat exchanger that uses the refrigerant that flows inside the refrigerant circuit as a cooling source.

15. The refrigeration device according to claim 7, further comprising a bypass circuit that can bypass the condenser and propagate refrigerant from the compressor to the user side heat exchanger.

16. The refrigeration device according to claim 15, further comprising an open/close mechanism configured to adjust the amount of the refrigerant that flows into the condenser.

17. The refrigeration device according to claim 16, wherein the condenser is a heat exchanger that uses the refrigerant that flows inside the refrigerant circuit as a cooling source.

18. The refrigeration device according to claim 17, wherein the refrigerant has saturation pressure characteristics that are higher than those of R407C.

* * * * *